US009824798B2

(12) United States Patent
Nam et al.

(10) Patent No.: US 9,824,798 B2
(45) Date of Patent: Nov. 21, 2017

(54) RESISTOR ELEMENT AND METHOD OF MANUFACTURING THE SAME

(71) Applicant: SAMSUNG ELECTRO-MECHANICS CO., LTD., Suwon-Si, Gyeonggi-Do (KR)

(72) Inventors: Jung Min Nam, Suwon-Si (KR); Jea Hoon Lee, Suwon-Si (KR); Young Key Kim, Suwon-Si (KR); Hae In Kim, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 14/953,940

(22) Filed: Nov. 30, 2015

(65) Prior Publication Data

US 2016/0172084 A1 Jun. 16, 2016

(30) Foreign Application Priority Data

Dec. 15, 2014 (KR) ..... 10-2014-0180322

(51) Int. Cl.

| | |
|---|---|
| ***H01C 1/012*** | (2006.01) |
| ***H01C 1/142*** | (2006.01) |
| ***H01C 1/01*** | (2006.01) |
| ***H01C 17/00*** | (2006.01) |
| ***H01C 17/28*** | (2006.01) |

(52) U.S. Cl.

CPC ..... *H01C 1/142* (2013.01); *H01C 1/01* (2013.01); *H01C 1/012* (2013.01); *H01C 17/006* (2013.01); *H01C 17/281* (2013.01)

(58) Field of Classification Search

CPC ..... H01C 1/14; H01C 14/142; H01C 1/012; H01C 17/065

USPC ..... 338/313, 325, 327, 332, 307, 309, 185, 338/295

See application file for complete search history.

(56) References Cited

U.S. PATENT DOCUMENTS 3,621,442 A * 11/1971 Racht ..... H01C 1/144 174/256
3,876,912 A * 4/1975 Sanders ..... H01C 13/02 338/309
3,996,551 A * 12/1976 Croson ..... H01C 7/006 216/16
4,041,440 A * 8/1977 Davis ..... H01C 1/16 29/620

(Continued)

FOREIGN PATENT DOCUMENTS

JP 05-055013 A 3/1993
JP 2007-194399 A 8/2007

(Continued)

*Primary Examiner* — Kyung Lee
(74) *Attorney, Agent, or Firm* — McDermott Will & Emery LLP

(57) ABSTRACT

A resistor element includes a base substrate, a resistor layer disposed on one surface of the base substrate, a first electrode layer and a second electrode layer disposed on the resistor layer spaced apart from each other, a third electrode layer disposed between the first electrode layer and the second electrode layer to be spaced apart from the first electrode layer and the second electrode layer and being thicker than each of the first electrode layer and the second electrode layer, and first to third plating layers disposed on the first to third electrode layers, respectively.

19 Claims, 7 Drawing Sheets

(56) References Cited

U.S. PATENT DOCUMENTS 5,179,366 A * 1/1993 Wagner ..... H01C 1/084 338/308
5,339,065 A * 8/1994 Slenker ..... H03H 7/25 333/81 A
5,929,746 A * 7/1999 Edwards, Jr. ..... H01C 1/14 338/203
5,977,863 A * 11/1999 Bloom ..... H01C 7/006 257/E23.175
6,097,276 A * 8/2000 Van Den Broek ..... H01C 7/06 338/22 R
6,314,637 B1 * 11/2001 Kimura ..... H01C 1/142 29/610.1
6,422,901 B1 * 7/2002 Belopolsky ..... H01C 1/01 439/620.16
7,038,571 B2 * 5/2006 Dunn ..... H01C 7/005 338/295
7,193,499 B2 * 3/2007 Tsukada ..... H01C 1/144 338/309
8,081,059 B2 * 12/2011 Tanimura ..... H01C 1/148 338/307
8,098,127 B2 * 1/2012 Tchaplia ..... H01P 5/16 338/254
8,581,687 B2 * 11/2013 Belman ..... H01C 1/16 29/621.1
2005/0285713 A1 * 12/2005 Kuriyama ..... H01C 1/16 338/260
2009/0085715 A1 * 4/2009 Zandman ..... H01C 1/014 338/275
2009/0085716 A1 * 4/2009 Kim ..... H01C 1/14 338/325
2013/0154790 A1 6/2013 Park et al.
2016/0125981 A1 * 5/2016 Kim ..... H01C 1/14 338/325

FOREIGN PATENT DOCUMENTS

JP 4056445 B2 3/2008
KR 10-2013-0070682 A 6/2013

* cited by examiner

RESISTOR ELEMENT AND METHOD OF MANUFACTURING THE SAME

CROSS-REFERENCE TO RELATED APPLICATION

This application claims the priority and benefit of Korean Patent Application No. 10-2014-0180322 filed on Dec. 15, 2014, with the Korean Intellectual Property Office, the disclosure of which is incorporated herein by reference.

BACKGROUND

The present disclosure relates to a resistor element, a method of manufacturing the same, and a board having the same.

A chip-type resistor element is suitable for implementing a precise degree of resistance, and serves to control an electric current and drop a level of a voltage in a circuit.

In circuits designed to use resistors, when the resistors are damaged by external impacts (power surges, static electricity discharges, and the like) to cause defects (short-circuits), increased currents in a power supply flow to integrated circuits (ICs), which leads to a secondary damage to the circuits.

In order to prevent the above-described problem, including a plurality of resistors in circuits at the time of designing the circuits may be considered. However, the above-described circuit design has a problem in that size of a substrate is inevitably increased.

In particular, in the case of mobile devices which have been gradually miniaturized, since the above-described increase in the size of the substrate for stability of the circuits is not preferable, improvement to a resistor element able to effectively control currents flowing in the circuits is required.

SUMMARY

An aspect of the present disclosure may provide a resistor element, a method of manufacturing the same, and a board having the same.

According to an aspect of the present disclosure, a resistor element may include a first electrode layer and a second electrode layer disposed on a resistor layer, and a third electrode layer disposed between the first electrode layer and the second electrode layer. The third electrode layer may be thicker than each of the first electrode layer and the second electrode layer, to reduce deviations in the thicknesses of the first to third terminals including the first to third electrode layers, respectively.

A third plating layer disposed on the third electrode layer may be thinner than each of first and second plating layers disposed on the first and second electrode layers, respectively.

The third electrode layer may include two or more layers.

According to another aspect of the present disclosure, a method of manufacturing a resistor element may include forming a resistor layer on a base substrate, forming first to third electrode layers on the resistor layer so that the third electrode layer is thicker than each of the first and second electrode layers, and forming plating layers on the first to third electrode layers, to thereby reduce deviations in thicknesses of terminals.

According to another aspect of the present disclosure, a board having a resistor element may include a resistor element and a circuit board on which the resistor element is mounted. The resistor element may have improved connectivity between electrode pads disposed on the circuit board and terminals at the time of mounting the resistor element on the circuit board.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
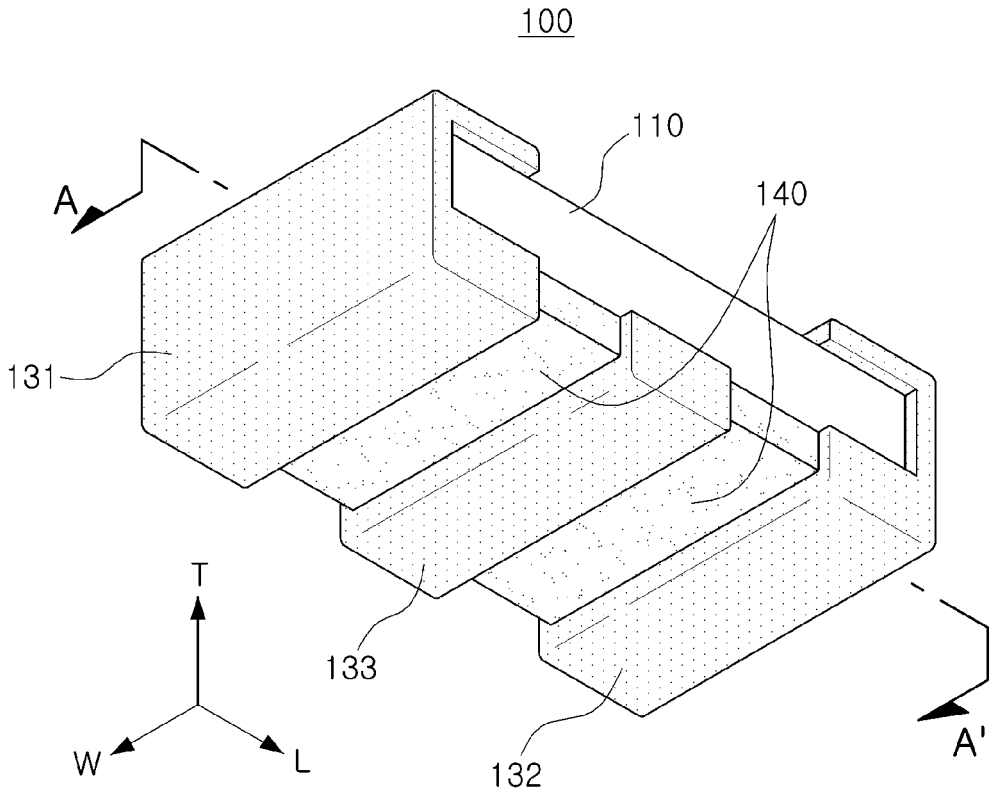
FIG. 1 is a perspective view of a resistor element according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Figure 2:
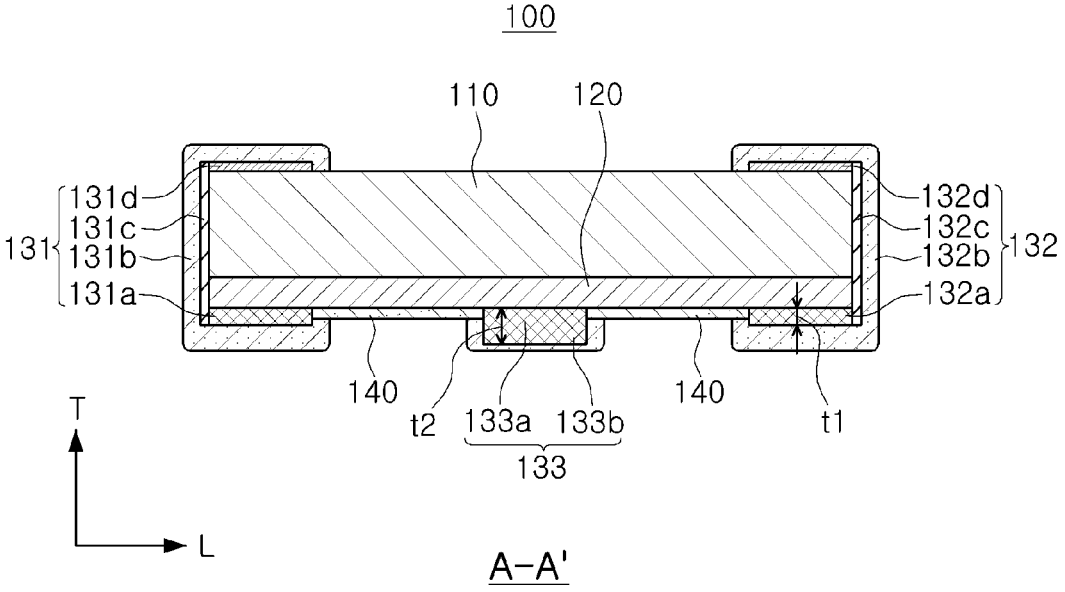
FIG. 2 is a cross-sectional view taken along line A-A' of FIG. 1.

FIG. 1 is a perspective view of a resistor element 100 according to an exemplary embodiment in the present disclosure, and FIG. 2 is a cross-sectional view taken along line A-A' of FIG. 1.

Referring to FIGS. 1 and 2, the resistor element 100 according to an exemplary embodiment in the present disclosure may include a base substrate 110, a resistor layer 120, and first to third terminals 131, 132, and 133.

The base substrate 110 may be provided to support the resistor layer 120, and secure strength of the resistor element 100. For example, the base substrate 110 may be provided as an aluminum substrate, an insulating substrate, or the like, but is not specifically limited thereto.

The base substrate 110 may have a rectangular parallelepiped thin plate shape, and may be formed of an alumina material insulated by anodizing a surface of the base substrate, but the material and the shape of the base substrate 110 are not limited thereto.

In addition, the base substrate 110 may be formed of a material having excellent thermal conductivity so as to serve as a thermal diffusion path through which heat generated from the resistor layer 120 radiates when the base substrate 110 is used for the resistor element.

The resistor layer 120 may be disposed on one surface of the base substrate 110, and may include a first resistor part connected to a first terminal 131 and a second terminal 132 to form resistance, and a second resistor part connected to the second terminal 132 and a third terminal 133 to form resistance, wherein the first resistor part and the second resistor part may be integrated with each other as illustrated in FIG. 2.

In the resistor element 100 according to an exemplary embodiment in the present disclosure, any one of the first resistor part and the second resistor part may be trimmed according to a resistance value thereof to determine a resistance value of the remaining resistor part by continuously trimming the remaining resistor part.

The trimming process refers to a cutting method for finely controlling resistance values, and the like, and may determine the resistance value set in each resistor part at the time of designing circuits.

According to an exemplary embodiment in the present disclosure, errors in resistance values may be reduced as compared to a case in which two single resistors are used or an array resistor is used.

The resistor layer 120 may include Ag, Pd, Cu, Ni, a Cu—Ni-based alloy, an Ni—Cr-based alloy, an Ru oxide, an Si oxide, Mn and Mn-based alloys, or the like, as a main component, and may include various materials depending on required resistance values, but the material of the resistor layer is not limited thereto.

The first to third terminals 131, 132, and 133 may include the first to third electrode layers 131*a*, 132*a*, and 133*a* disposed on the resistor layer 120, respectively, and may include first to third plating layers 131*b*, 132*b* and 133*b* disposed on the first to third electrode layers 131*a*, 132*a*, and 133*a*, respectively.

For example, as illustrated in FIG. 2, the first terminal 131 may include the first electrode layer 131*a* and the first plating layer 131*b*, the second terminal 132 may include the second electrode layer 132*a* and the second plating layer 132*b*, and the third terminal 133 may include the third electrode layer 133*a* and the third plating layer 133*b*.

The first to third electrode layers 131*a*, 132*a*, and 133*a* may be disposed on one surface of the resistor layer 120 to be spaced apart from each other, and the third electrode layer 133*a* may be disposed between the first electrode layer 131*a* and the second electrode layer 132*a*.

According to an exemplary embodiment in the present disclosure, a thickness t2 of the third electrode layer 133*a* on which the plating layer may be formed relatively thinly may be formed to be thicker than a thickness t1 of each of the first and second electrode layers 131*a* and 132*a*.

According to an exemplary embodiment in the present disclosure, the third electrode layer 133*a* may have relatively the greatest thickness, such that entire thickness of the first to third terminals 131, 132, and 133 including the electrode layer and the plating layer may be uniform.

The first to third electrode layers 131*a*, 132*a*, and 133*a* may be formed by coating the resistor layer 120 with a conductive paste for forming conductive electrodes. The conductive paste may be coated using a screen printing process, or the like, but the forming method of the electrode layers is not limited thereto.

The first to third electrode layers 131*a*, 132*a*, and 133*a* may be formed of materials different from those of the above-described resistor element. For example, the materials of the electrode layers 131*a*, 132*a*, and 133*a* may be copper, nickel, platinum, and the like, or may be the same component as the resistor element if needed.

According to an exemplary embodiment in the present disclosure, the third electrode layer 133*a* may be formed to be relatively thick by applying a relatively great amount of paste as compared to the amount of paste used to form the first and second electrode layers 131*a* and 132*a*.

Figure 3:
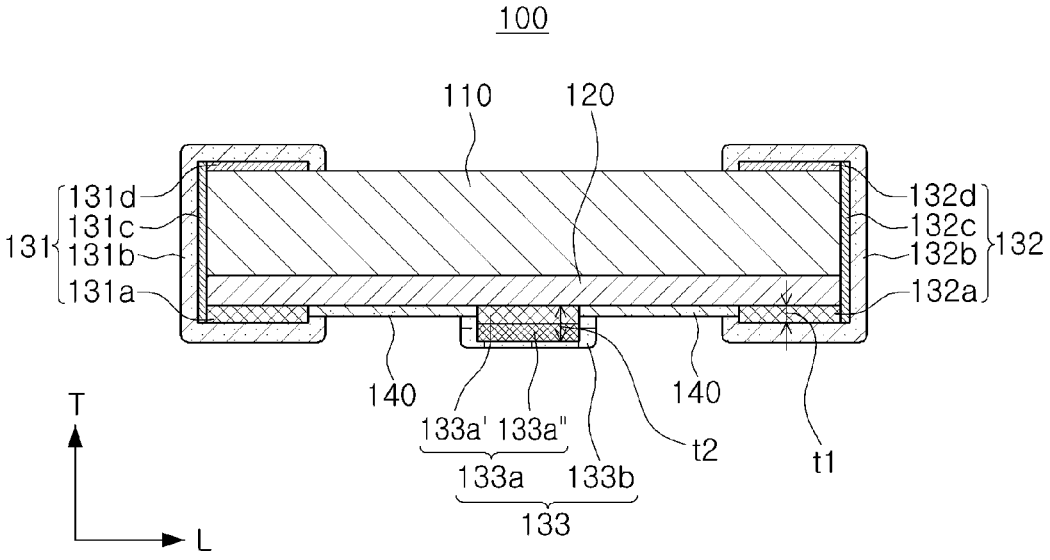
FIG. 3 is a cross-sectional view illustrating a resistor element according to a modified example of the present disclosure.

Otherwise, as illustrated in FIG. 3, a modified example of an exemplary embodiment in the present disclosure, the third electrode layer 133*a* may include two or more layers 133*a*' and 133*a*", such that the thickness t2 of the third electrode layer 133*a* may be thicker than that of the thickness t1 of each of the first and second electrode layers 131*a* and 132*a*.

According to an exemplary embodiment in the present disclosure, one integrated resistor layer 120 may include the first resistor part and the second resistor part to improve a space utilization efficiency as compared to a case in which the first resistor part and the second resistor part are separately formed.

The first resistor part may be formed between the first terminal 131 and the third terminal 133, and the second resistor part may be formed between the second terminal 132 and the third terminal 133, to thereby control currents flowing in circuits. The first resistor part and the second resistor part may use the third terminal 133 as a common terminal.

The circuits formed on the substrate may use resistors to control the currents, wherein in order to prevent the circuits from being damaged by the resistors damaged by external impacts (surges, static electricity discharges, and the like), two or more resistor elements may be used or an array resistor in which respective resistor parts are connected to a pair of independent terminals may be used. Meanwhile, when two or more resistor elements are used or the existing array resistor is used, a relatively large mounting space may be required.

According to an exemplary embodiment in the present disclosure, one resistor element 100 includes the three terminals 131, 132, and 133, and two resistor parts each disposed between two terminals, such that the space of the substrate on which the resistor element is disposed may be reduced to improve space utilization efficiency, and a device including the resistor element may be miniaturized and precisely formed, as compared to a case in which two resistor elements each including one resistor part are used or a case in which an array resistor in which respective resistor parts are connected to a pair of independent terminals is used.

In addition, in the resistor element 100 according to an exemplary embodiment in the present disclosure, the resistor layer 120 may be first formed on one surface of the base substrate 110, and then the first to third electrode layers 131*a*, 132*a*, and 133*a* may be formed on the resistor layer 120, to form the first to third terminals 131, 132, and 133. Accordingly, area of the resistor layer may be expanded as compared to a resistor element manufactured by first forming electrode layers on abase substrate and then forming a resistor layer to overlap with the electrode layers.

According to an exemplary embodiment in the present disclosure, power of the resistor element 100 may be increased by the expansion of the area of the resistor layer 120, the electrode layers 131*a*, 132*a*, and 133*a* may be disposed on the resistor layer 120, such that respective overlapped areas between the resistor layer 120 and the first to third electrode layers 131*a*, 132*a*, and 133*a* may be uniformly formed to improve resistance value variations (non-uniformity).

According to an exemplary embodiment in the present disclosure, first and second back surface electrodes 131*d* and 132*d* may be selectively disposed on the other surface of the base substrate to face the first and second electrode layers 131*a* and 132*a*. When the first and second back surface electrodes 131*d* and 132*d* are disposed on the other surface of the base substrate 110, the first and second electrode layers 131*a* and 132*a* and the first and second back surface electrodes 131*d* and 132*d* may offset power of the resistor element 100 having an effect on the base substrate during a sintering process, to prevent the base substrate from being bent by the resistor element.

The first and second back surface electrodes 131*d* and 132*d* may be formed by printing a conductive paste, but the forming method of the back surface electrodes is not limited thereto.

According to an exemplary embodiment in the present disclosure, both end surfaces of a laminate formed of the base substrate 110, the resistor layer 120, and the first to third electrode layers 131*a*, 132*a*, and 133*a* may be provided with a pair of side surface electrodes 131*c* and 132*c* connected to the first and second electrode layers, respectively.

The laminate may selectively include the above-described first and second back surface electrodes 131*d* and 132*d*.

When the laminate includes the first and second back surface electrodes 131*d* and 132*d*, the pair of side surface electrodes 131*c* and 132*c* may be disposed so that the first electrode layer 131*a* and the second electrode layer 132*a* are connected to the first back surface electrode 131*d* and the second back surface electrode 132*d*, respectively.

The pair of side surface electrodes 131*c* and 132*c* may be formed at end surfaces of the laminate by sputtering conductive materials forming the side surface electrodes 131*c* and 132*c*, but the forming method of the side surface electrode is not limited thereto.

According to an exemplary embodiment in the present disclosure, a protective layer 140 provided to protect the resistor layer from external impact may be disposed on a surface of the resistor layer without the first to third electrode layers 131*a*, 132*a*, and 133*a* disposed thereon.

The protective layer 140 may be formed of silicon oxide ($SiO_2$) or a glass material, and may be formed on the resistor layer 120 using an overcoating process, but the material of the protective layer is not limited thereto.

When the electrode layers 131*a*, 132*a* and 133*a* are disposed on the resistor layer 120 according to an exemplary embodiment in the present disclosure, even in the case that the protective layer 140 is disposed on the resistor layer 120, the first to third terminals 131, 132, and 133 protrude further than the protective layer 140. Accordingly, at the time of mounting the resistor element on the substrate, the terminals 131, 132, and 133 may easily contact electrode pads disposed on the substrate.

According to an exemplary embodiment in the present disclosure, the protective layer 140 may be formed and then in order to mount the resistor element on the substrate, first to third plating layers 131*b*, 132*b*, and 133*b* may be formed on the first to third electrode layers 131*a*, 132*a*, and 133*a*, respectively.

When the resistor element 100 according to an exemplary embodiment in the present disclosure includes the back surface electrodes 131*d* and 132*d* and the side surface electrodes 131*c* and 132*c*, the plating layers 131*b* and 132*b* may even be formed on the back surface electrodes and the side surface electrodes.

For example, the first plating layer 131*b* may cover the first electrode layer 131*a*, the first back surface electrode 131*d*, and the side surface electrode 131*c* connecting the first electrode layer and the first back surface electrode, and the second plating layer 132*b* may cover the second electrode layer 132*a*, the second back surface electrode 132*d*, and the side surface electrode 132*c* connecting the second electrode layer and the second back surface electrode.

According to an exemplary embodiment in the present disclosure, the plating layers 131*b*, 132*b*, and 133*b* may be formed by a barrel plating method. As compared to the first and second electrode layers, the third electrode layer may have a low possibility of electricity conduction due to contact, and thus the plating of the third electrode layer may be mainly performed by electricity conduction through the resistor layer. Since the resistor layer generally has conductivity lower than that of the electrode layer, the third plating layer 133*b* provided on the third electrode layer 133*a* may be thinner than the first and second electrode layers 131*a* and 132*a*.

Accordingly, when the third electrode layer 133*a* has the same thickness as that of each of the first and second electrode layers 131*a* and 132*a*, the third plating layer 133*b* may be thinner than the first and second plating layers 131*b* and 132*b*. Accordingly, the third terminal 133 may be thinner than the first and second terminals 131 and 132. In this case, at the time of mounting the resistor element on the circuit board, the third terminal 133 may not contact a solder, and thus mounting defects in which the third terminal is not connected to the circuit board may occur.

However, according to an exemplary embodiment in the present disclosure, the third electrode layer 133*a* disposed between the first and second electrode layers 131*a* and 132*a* may be thicker than the first and second electrode layers, and thus a problem occurring when the third plating layer is thin may be improved.

According to an exemplary embodiment in the present disclosure, the third electrode layer may be printed in a multilayer manner, such that the third terminal may have a height within 20 μm after forming of the plating layer.

According to an exemplary embodiment in the present disclosure, in order to compensate for the third plating layer 133*b* formed to be relatively thin due to a small amount of electricity conduction at the time of forming the plating layers, the third electrode layer 133*a* may be formed to be relatively thick or may be formed in a multilayer structure, such that at the time of mounting the resistor element on the circuit board, connection of three terminals may be stably achieved.

In addition, after mounting the resistor element on the circuit board, the third terminal 133 may stably contact the solder to increase fixation strength of the resistor element 100, and surface area of the third terminal 133 may be expanded to increase a heat radiation effect, thereby improving power properties of the resistor element 100.

Method of Manufacturing Resistor Element

Figure 4:
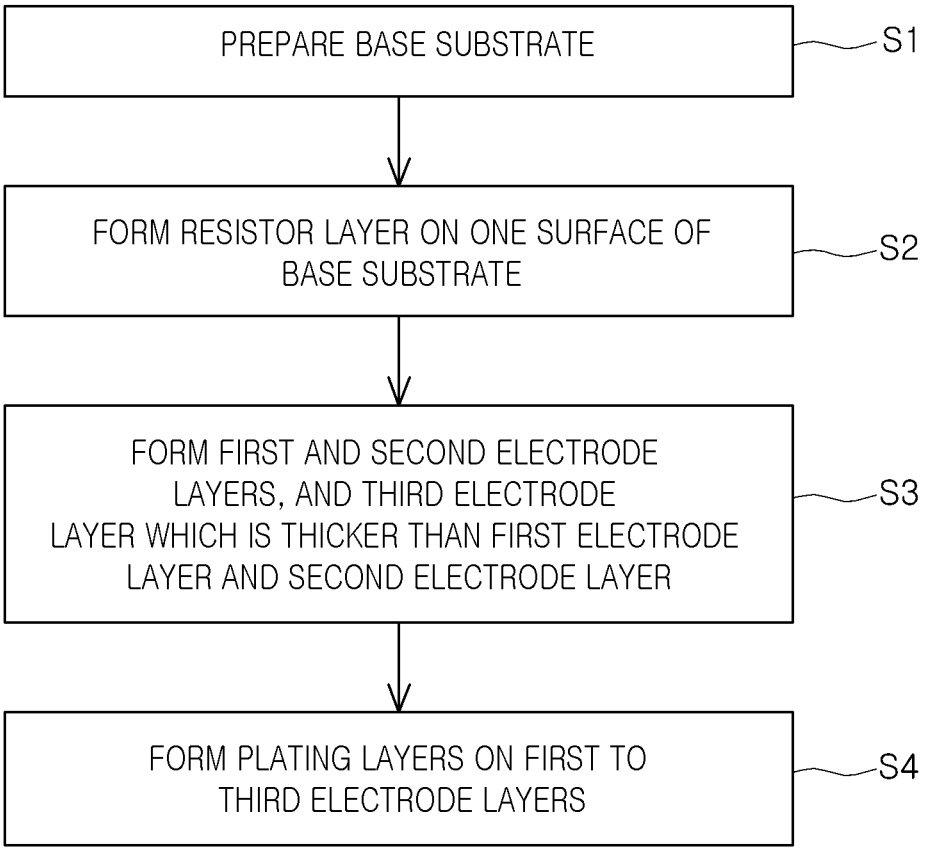
FIG. 4 is a flow chart illustrating a method of manufacturing a resistor element according to another exemplary embodiment in the present disclosure.

FIG. 4 is a flow chart illustrating a method of manufacturing a resistor element according to the present exemplary embodiment in the present disclosure.

Referring to FIG. 4, the method of manufacturing the resistor element according to an exemplary embodiment in the present disclosure may include preparing a base substrate (S1), forming a resistor layer on one surface of the base substrate (S2), forming first to third electrode layers on the resistor layer (S3), and forming plating layers on the first to third electrode layers (S4).

In the manufacturing method according to another exemplary embodiment in the present disclosure, description of the same characteristics as the characteristics of the above-described resistor element according to the exemplary embodiment in the present disclosure will be omitted.

First, the base substrate 110 for disposing the resistor layer and the electrode layers may be prepared (S1). Then, the resistor layer 120 may be formed on one surface of the base substrate 110, and may be formed by printing a resistor paste (S2).

Next, the first and second electrode layers 131*a* and 132*a* spaced apart from each other, and the third electrode layer 133*a* may be formed on one surface of the resistor layer (S3). The third electrode layer 133*a* may be disposed between the first and second electrode layers to be spaced apart from the first and second electrode layers.

Here, the third electrode layer may be formed to be thicker than the first and second electrode layers. The third electrode layer may be formed to be thicker than each of the first and second electrode layers by controlling the amount of a paste, or by forming the third electrode layer of two or more layers.

Next, first and second back surface electrodes 131*d* and 132*d* may be formed on other surface of the base substrate if needed, and side surface electrodes 131*c* and 132*c* may be formed on both end surfaces of a laminate in which the base substrate, the resistor layer, the first to third electrode layers, and selectively, the first and second back surface electrodes are stacked.

The side surface electrodes may be formed using a sputtering process.

Next, the first to third plating layers 131*b*, 132*b*, and 133*b* may be formed on the first to third electrode layers, respectively (S4). The first to third plating layers may be formed using a barrel plating method.

According to an exemplary embodiment in the present disclosure, since the third electrode layer 133*a* may be thicker than each of the first and second electrode layers 131*a* and 132*a*, even though the third plating layer 133*b* is thinner than each of the first and second plating layers 131*b* and 132*b*, non-uniform thicknesses of the first to third terminals 131, 132, and 133 may be overcome.

Board on which Resistor Element is Mounted 200

Figure 5:
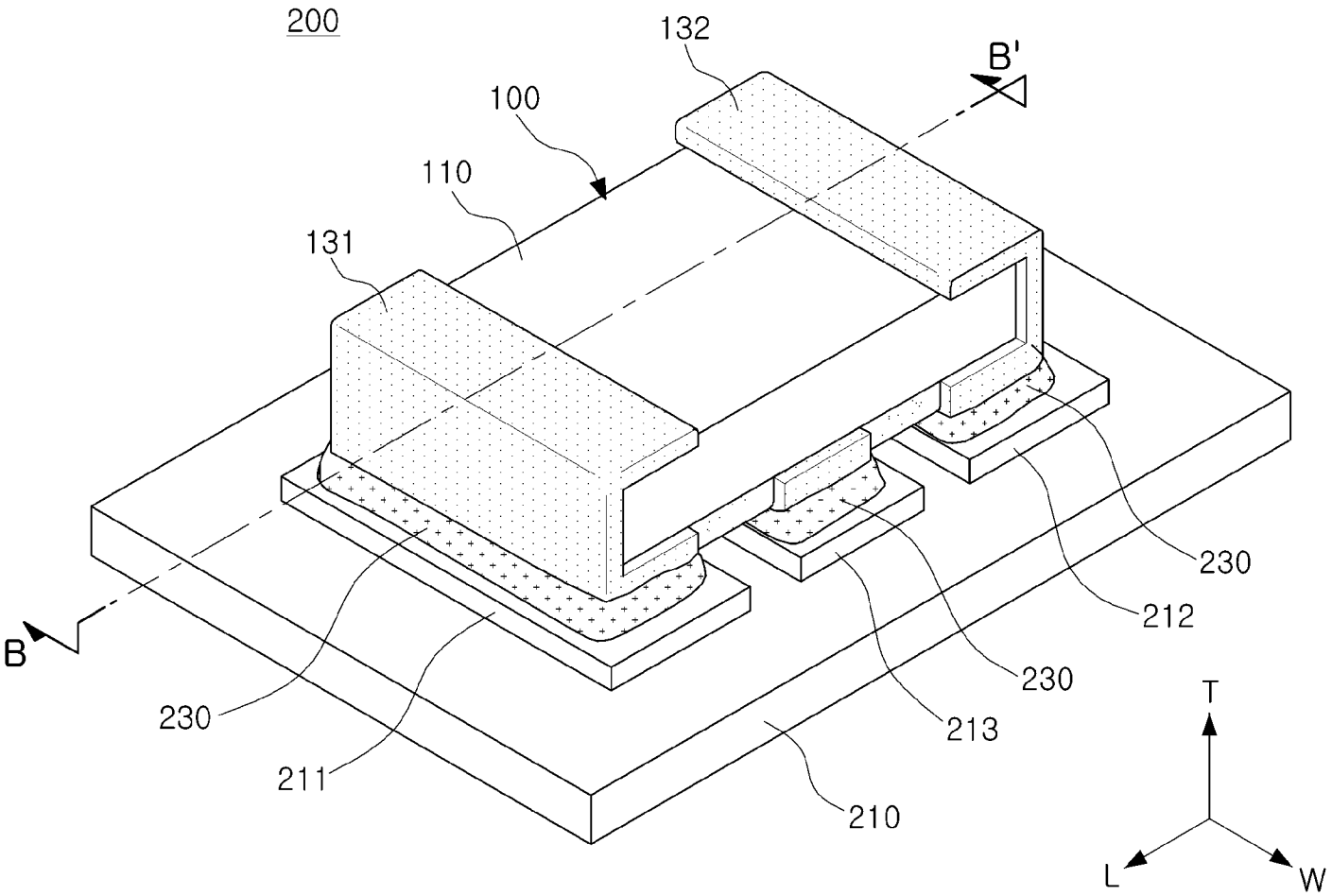
FIG. 5 is a perspective view of a board having the resistor element according to another exemplary embodiment in the present disclosure.
Figure 6:
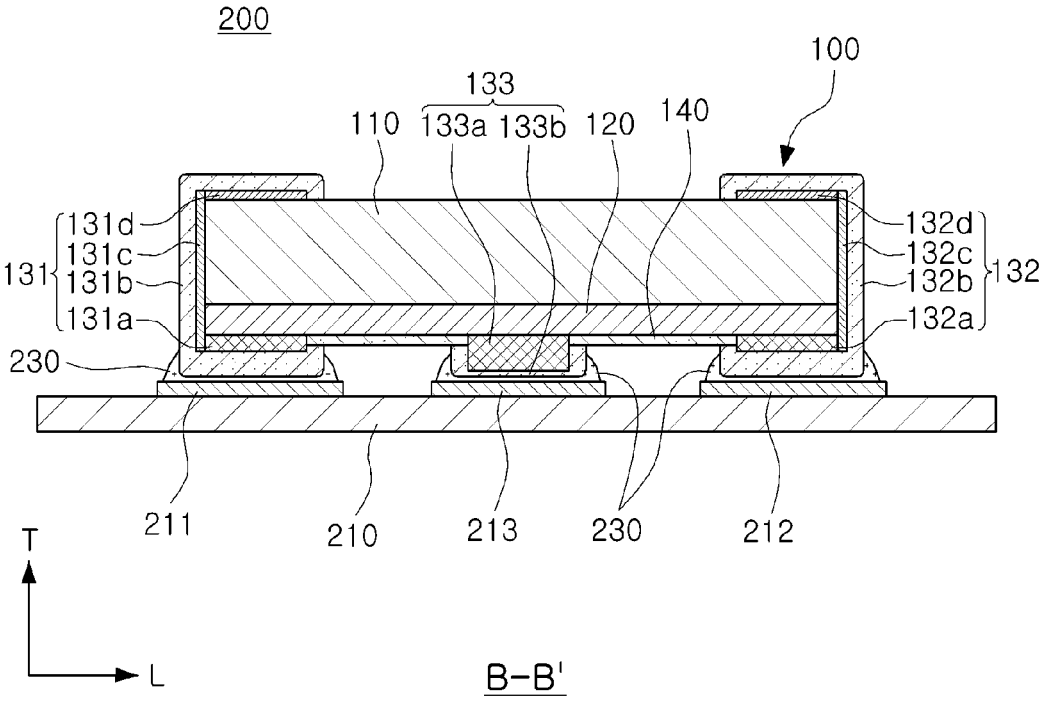
FIG. 6 is a cross-sectional view taken along line B-B' of FIG. 5.

FIG. 5 is a perspective view of a board having the resistor element according to another exemplary embodiment in the present disclosure, and FIG. 6 is a cross-sectional view taken along line B-B' of FIG. 5.

Referring to FIGS. 5 and 6, the board 200 on which the resistor element is mounted according to the present exemplary embodiment in the present disclosure may include a resistor element 100 and a circuit board 210 on which the first to third electrode pads 211, 212, and 213 are disposed to be spaced apart from each other.

The resistor element 100 may include a base substrate 110, a resistor layer 120 disposed on one surface of the base substrate, a first electrode layer 131*a* and a second electrode layer 132*a* spaced apart from each other on the resistor layer, a third electrode layer 133*a* disposed between the first electrode layer and the second electrode layer to be spaced apart from the first electrode layer and the second electrode layer and being thicker than the first electrode layer and the second electrode layer, and first to third plating layers 131*b*, 132*b*, and 133*b* disposed on the first to third electrode layers, respectively.

Descriptions of the resistor element 100 according to the present exemplary embodiment in the present disclosure are common with that of the resistor element according to the above-described exemplary embodiment in the present disclosure, and thus common descriptions will be omitted.

The circuit board 210 has electronic circuits formed thereon. That is, integrated circuits (IC) for specific operations or a control of electronic devices, or the like, may be formed on the circuit board, such that currents supplied from a separate power supply may flow in the circuits.

In this case, the circuit board 210 may include various wiring lines or may further include different kinds of semiconductor devices such as a transistor, and the like. In addition, the circuit board 210 may include a conductive layer, a dielectric layer, and the like, to be variously configured if needed.

The first to third electrode pads 211, 212, and 213 may be spaced apart from each other on the circuit board 210, and may be connected to the first to third terminals 131, 132, and 133 of the resistor element 100, respectively.

Through the first to third electrode pads 211, 212, and 213, the first to third terminals 131, 132, and 133 may be electrically connected to the electrical circuits, such that the first resistor part and the second resistor part formed between the first to third terminals 131, 132, and 133 may be connected to the circuit.

Figure 7:
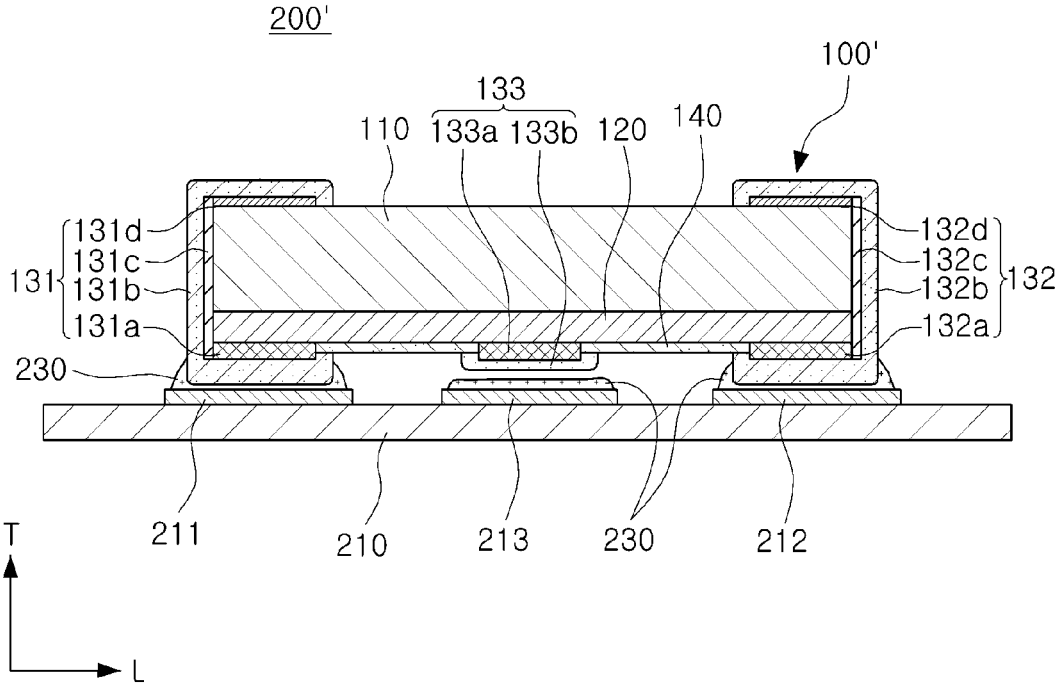
FIG. 7 is a cross-sectional view illustrating a board having a resistor element according to Comparative Example mounted thereon.

FIG. 7 is a cross-sectional view illustrating a board having a multi-terminal resistor element, according to the Comparative Example.

FIG. 7 illustrates the resistor element 100' in which the third electrode layer 133*a* has the same thickness as that of each of the first and second electrode layers 131*a* and 132*a*, wherein the third plating layer 133*b* disposed on the third electrode layer 133*a* may be formed to be thin, such that the third terminal 133 may be thinner than the first and second terminals 131 and 132.

In a case in which the third terminal 133 is thinner than the first and second terminals 131 and 132 as illustrated in FIG. 7, the solder 230 may not contact the third terminal 133, and thus the third terminal 133 may not be electrically connected to the third electrode pad 213 of the printed circuit board 210. Accordingly, defects may occur at the time of mounting the resistor element 100' on the printed circuit board 210.

However, according to the exemplary embodiment in the present disclosure, the third electrode layer 133*a* may be thicker than each of the first and second electrode layers 131*a* and 132*a*, to thereby reduce deviations in thicknesses of the first to third terminals to stably secure connectivity between electrode pads disposed on the circuit board and terminals.

As set forth above, according to exemplary embodiments in the present disclosure, there are provided a resistor element having excellent space utilization efficiency at the time of mounting the resistor element on a circuit board and being stably connected to the circuit board, a method of manufacturing the same, and a board having the same.

While exemplary embodiments have been shown and described above, it will be apparent to those skilled in the art that modifications and variations could be made without departing from the scope of the present disclosure as defined by the appended claims.

What is claimed is:

1. A resistor element comprising:

a base substrate;

a resistor layer on one surface of the base substrate;

a first electrode layer and a second electrode layer on the resistor layer, spaced apart from each other;

a third electrode layer between the first electrode layer and the second electrode layer to be spaced apart from the first electrode layer and the second electrode layer; and first to third plating layers on the first to third electrode layers, respectively, wherein a height of the third electrode layer is greater than a height of each of the first electrode layer and the second electrode layer.

2. The resistor element of claim 1, wherein the third electrode layer includes two or more layers.

3. The resistor element of claim 1, wherein each of the first and second plating layers has a height greater than a height of the third plating layer.

4. The resistor element of claim 3, wherein each of the first and second plating layers is thicker from the respective first and second electrode layers than the third plating layer from the third electrode layer.

5. The resistor element of claim 1, wherein the resistor layer includes:

a first resistor part connected to a first terminal including the first electrode layer and a second terminal including the second electrode layer to form resistance; and a second resistor part connected to the second terminal and a third terminal including the third electrode layer to form resistance, and the first resistor part is integrally formed with the second resistor part.

6. The resistor element of claim 1, wherein the first to third plating layers are formed using barrel plating.

7. The resistor element of claim 1, wherein the resistor layer includes:

a first resistor part connected to a first terminal including the first electrode layer and a second terminal including the second electrode layer to form resistance; and a second resistor part connected to the second terminal and a third terminal including the third electrode layer to form resistance, and either one of the first resistor part and the second resistor part is trimmed according to a resistance value thereof to determine a resistance value of the remaining resistor part.

8. The resistor element of claim 1, further comprising a protective layer disposed on portions of a surface of the resistor layer exposed among the first to third electrode layers.

9. The resistor element of claim 1, further comprising first and second back surface electrodes and selectively disposed on the other surface of the base substrate to face the first and second electrode layers.

10. The resistor element of claim 9, further comprising first and second side surface electrodes connecting the first and second electrode layers and the first and second back surface electrodes to each other, respectively.

11. The resistor element of claim 10, wherein the first and second plating layers cover the first and second electrode layers, the first and second side surface electrodes, and the first and second back surface electrodes, respectively.

12. The resistor element of claim 1, wherein the third electrode layer is arranged to overlap the first electrode layer and the second electrode layer when viewed in a length direction of the resistor element.

13. A method of manufacturing a resistor element comprising:

preparing a base substrate;

forming a resistor layer on one surface of the base substrate;

forming a first electrode layer and a second electrode layer, and a third electrode layer between the first electrode layer and the second electrode layer; and forming first to third plating layers on the first to third electrode layers, respectively, wherein a height of the third electrode layer is greater than a height of each of the first electrode layer and the second electrode layer.

14. The method of claim 13, wherein the third electrode layer includes two or more layers.

15. The method of claim 13, wherein each of the first and second plating layers has a height greater than a height of the third plating layer.

16. The method of claim 15, wherein each of the first and second plating layers is thicker from the respective first and second electrode layers than the third plating layer from the third electrode layer.

17. The method of claim 13, wherein the first to third plating layers are formed using a barrel plating method.

18. The method of claim 13, further comprising forming a protective layer on portions of a surface of the resistor layer exposed among the first to third electrode layers, prior to forming the first to third plating layers.

19. The method of claim 13, wherein the third electrode layer is arranged to overlap the first electrode layer and the second electrode layer when viewed in a length direction of the resistor element.

* * * * *